US005442125A

United States Patent [19]

Hanzawa et al.

[11] Patent Number: 5,442,125

[45] Date of Patent: Aug. 15, 1995

[54] SIGNAL PROCESSING APPARATUS FOR REPEATEDLY PERFORMING A SAME PROCESSING ON RESPECTIVE OUTPUT CHANNELS IN TIME SHARING MANNER

[75] Inventors: Kohtaro Hanzawa, Iruma; Goro Sakata, Mitaka; Kikuji Tanaka, Fussa, all of Japan

[73] Assignee: Casio Computer Co., Ltd., Tokyo, Japan

[21] Appl. No.: 295,353

[22] Filed: Aug. 24, 1994

Related U.S. Application Data

[63] Continuation of Ser. No. 917,904, Jul. 21, 1992, abandoned, which is a continuation of Ser. No. 775,150, Oct. 9, 1991, abandoned.

[30] Foreign Application Priority Data

Nov. 20, 1990 [JP] Japan ..... 2-315250

[51] Int. Cl.[6] ..... G10H 7/00

[52] U.S. Cl. ..... 84/602; 84/617; 84/655

[58] Field of Search ..... 84/600–602, 84/609–614, 617, 625, 634–638, 655, 682

[56] References Cited

U.S. PATENT DOCUMENTS

| | | | |
|---|---|---|---|
| 4,254,498 | 3/1981 | Tawara et al. | 370/63 |
| 4,338,844 | 7/1982 | Murata | 84/655 |
| 4,373,415 | 2/1983 | Kondo | 84/655 |
| 4,547,877 | 10/1985 | Lehman et al. . | |
| 4,667,556 | 5/1987 | Hanzawa et al. . | |
| 4,713,996 | 12/1987 | Oguri | 84/DIG. 12 X |
| 4,920,849 | 5/1990 | Mizuno | 84/613 |
| 4,922,796 | 5/1990 | Kondo et al. | 84/618 |
| 4,926,736 | 5/1990 | Kozuki | 84/609 |
| 4,939,973 | 7/1990 | Suzuki | 84/605 |
| 4,939,974 | 7/1990 | Ishida et al. | 84/609 |
| 4,974,143 | 11/1990 | Yamada . | |
| 5,113,741 | 5/1992 | Nishikawa | 84/609 |
| 5,131,309 | 7/1992 | Nishikawa et al. | 84/601 |
| 5,168,116 | 12/1992 | Iizuka | 84/603 |
| 5,200,565 | 4/1993 | Satoshi et al. | 84/602 |
| 5,248,842 | 9/1993 | Saito | 84/602 |

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

A signal processing apparatus according to the present invention is used as a sound source, an effecting machine and/or a communication equipment, which simultaneously generates or processes a plurality of musical tones and sounds on the basis of a plurality of input data such as performance data, musical tone data and/or communication data. This signal processing apparatus stores a program prepared for controlling operation to generate or process musical tones and sounds only for one channel. The program is read out in accordance with a lower bit of a readout counter. A upper bit of the readout counter is used to designate a channel to which the generated or processed musical tones and sounds are assigned in accordance with the read out program. As a result, only a small area is required for storing the program and a simple construction may be employed in the apparatus.

5 Claims, 9 Drawing Sheets

SELECTING SIGNAL FROM CPU
WF
DATA
FRAM Adrs
BC
11
BC^U
BC^L
3
1
φ
16
FRAM
13
AVF
ALF
WF
OUTF
DATA
REGISTER
17
φ1
SRAM
14
AVs
ALs
INs
OUTs
WS
REGISTER
18
φ1
μROM
MICRO PROGRAM ROM
12
OP
W
DEC
DECODER
15
CLKO
WS
φ3
CARRY
ALU
19
OP
REGISTER
20
φ2
OUTPUT REGISTER
21
CLKO
OUT
22
φ
CARRY φ1=CLKFS
φ2=CLKOP
φ3
φ
BC
(BC^U)
(BC^L)=μP.A
μP (INSTRUCTIONS OF MICRO PROGRAM)
AVF,ALF
AVs, ALs
F.R (REGISTER 17)
S.R (REGISTER 18)
OP.R (REGISTER 20)
WS
CLKO
OUT
00
01
02
03
04
05
000
001
002
0
1
OUT:=FO+SO
SO:=FO+SO
0-FO
1-FO
2-FO
0-SO
1-SO
2-SO
(0-FO)
(1-FO)
(2-FO)
(0-SO)
(1-SO)
(2-SO)
(0-FO)+(0-SO)
(1-FO)+(1-SO)
(2-FO)+(2-SO)
Σ (0-FO)
Σ (1-FO)
Σ (2-FO)
0 CHANNEL
1 CHANNEL
2 CHANNEL

SIGNAL PROCESSING APPARATUS FOR REPEATEDLY PERFORMING A SAME PROCESSING ON RESPECTIVE OUTPUT CHANNELS IN TIME SHARING MANNER

This application is a Continuation of application Ser. No. 07/917,904, filed Jul. 21, 1992, (abandoned) which is a Continuation of Ser. No. 07/775,150, filed Oct. 9, 1991 (abandoned).

BACKGROUND OF THE INVENTION

1. Field of the Invention

The present invention relates to a signal processing apparatus and, more specifically, relates to a signal processing apparatus which performs repeatedly the same processing for respective output channels in a time sharing fashion.

2. Description of the Related Art

In recent, a signal processing unit is known which performs operation on an input signal in accordance with a predetermined algorithm, and which is used as a sound source and an effector in an electronic musical instrument, and further is used in a wide variety of appliances such as audio equipments and communication equipments. The signal processing unit used in these appliances is required to process a number of data in a very short time. Such operation includes multiplication, addition, subtraction, Laplace transform, etc. And the input data to be processed by the signal processing unit are of large bits. Therefore, it is not efficient and economical to provide the signal processing unit with separate and independent operational elements prepared for respective operations.

Hence, another signal processing unit is proposed in which a single operational element performs various operation in a time sharing fashion in accordance with a micro-program stored within the signal processing unit.

More recently, however, an electronic musical instrument involves multi-channels so as to generate a plurality of musical tones at the same time while a communication system of multi-channels simultaneously transmits signals to a plurality of receivers. The signal processing apparatus employed in the multi-channel musical instrument and multi-channel communication system are arranged to receive signals for respective channels in a time sharing fashion and to sequentially perform operation on the signals received in a time sharing fashion.

Since the multi-channel signal processing apparatus performs operation for each channel, it requires substantially similar programs for respective channels, resulting in including a large storage capacity for storing these programs.

Some multi-channel signal processing apparatus holds a program for one channel as a sub-routine program and reads out the sub-routine program every time when it executes processing for each channel. In such multi-channel signal processing apparatus, however, a stack area is needed for program counter under an instruction of a sub-routine jump and there is a disadvantage that the time to execute the jump instruction reduces the net time for performing other operation.

SUMMARY OF THE INVENTION

The present invention has been made to solve the prior art problems described above, and has an object to provide a signal processing apparatus used in an electronic musical instrument which controls operation for a plurality of musical-tone channels, using efficiently memory means for storing a micro-program and without reducing the net time for performing operation.

According to one aspect of the invention, there is provided a signal processing apparatus for an electronic musical instrument, which comprises performance data input means for inputting performance data for a plurality of musical tone channels; clock signal generating means for generating reference clock signals; first memory means for storing a program prepared for generating musical tones for one musical tone channel; readout means for counting the reference clock signals generated by said clock signal generating means to provide a count output of a plurality of bits, and for sequentially reading the program stored in said first memory means in accordance with a lower bit output of the count output, and for designating a musical tone channel in accordance with a upper bit output of the count output; and processing means for generating, in accordance with the program read by said readout means, musical tone data on the basis of the performance data inputted to each musical tone channel by said performance data input means, and for assigning the musical tone data thus generated to the plurality of musical tone channels in accordance with the upper bit output of the count output provided by said readout means.

Now, we assume that a single microprogram prepared for generating musical tones for one musical tone channel is stored in the first memory means of the above signal processing apparatus. The readout means counts the reference clock signals to provide the count output of a plurality of bits, the count output of which is divided into a upper bit output and a lower bit output, and then the readout means successively reads microprogram from the first memory means on the basis of the lower bit output while it designates a musical tone channel on the basis of the upper bit output. Then, musical tone data are generated, in accordance with the microprogram read by the readout means, on the basis of the performance data inputted from the performance data input means. Meanwhile, the readout means further continues to count the reference clock signals, providing successively new upper bit outputs. As a result, another musical tone channels are designated based on the new upper bit outputs and the generated musical tone data are successively assigned to these musical tone channels thus designated.

In this manner, operation for generating musical tone data for a plurality of musical tone channels is performed in accordance with the single microprogram prepared for one musical tone channel, stored in the first memory means. Therefore, a less storage area in the first memory means is enough for storing the microprograms and neither program counter nor peripheral logic circuit is needed in the signal processing apparatus.

Another object of the invention is to provide a signal processing apparatus which is capable of controlling operation for generating musical tone data for a plurality of channels, using efficiently memory means for storing micro-program and without reducing the net time for performing the operation.

According to another aspect of the invention, there is provided a signal processing apparatus for an electronic musical instrument, which comprises musical tone data input means for inputting musical tone data for a plurality of musical tone channels; clock signal generating means for generating reference clock signals; first memory means for storing a program prepared for processing musical tones for one musical tone channel; readout means for counting the reference clock signals generated by said clock signal generating means to provide a count output of a plurality of bits, the count output including a lower bit output and a upper bit output, and for sequentially reading the program stored in said first memory means in accordance with the lower bit output of the count output, and for designating a musical tone channel in accordance with the upper bit output of the count output; and processing means having a plurality of musical tone channels, for generating, in accordance with the program read by said readout means, musical tone data inputted to each musical tone channel by said musical tone data input means, and for assigning the musical tone data thus generated to the plurality of musical tone channels in accordance with the upper bit output of the count output provided by said readout means.

In the above signal processing apparatus, the readout means counts the reference signals to provide a count output including a lower bit output and a upper bit output, and said means successively reads out instructions of the microprogram in accordance with the upper bit output and simultaneously designates channels in accordance with the upper output. Therefore, the microprogram prepared for processing musical tones for one channel and for imparting particular effects onto them is allowed to control operation for generating musical tones for a plurality of channels and impart effects onto them. As a result, only a small area is required for storing the microprogram, and a sub-routine jump is not needed so that the net time for performing operation is not reduced and peripheral circuits may be omitted. Therefore, simple and easy circuit design is allowed, and low costs for designing and manufacturing apparatus may be expected.

Yet another object of the present invention is to provide a signal processing apparatus which is capable of controlling operation for a plurality of channels, using efficiently memory means for storing process program and without reducing the time for performing the operation.

According to yet another aspect of the present invention, there is provided a signal processing apparatus, which comprises data input means for inputting data for a plurality of channels; clock signal generating means for generating reference clock signals; first memory means storing a process program prepared for one channel; readout means for counting the reference clock signals generated by said clock signal generating means to provide a count output of a plurality of bits, the count output including a lower bit output and a upper bit output, and for sequentially reading the process program stored in said first memory means in accordance with the lower bit output of the count output, and for designating channels in accordance with the upper bit output of the count output; and processing means having a plurality of channels, for processing data inputted to respective channels in accordance with the process program read out by said readout means, and for assigning the processed data to the corresponding channels in accordance with the upper bit output of the count output provided by said readout means.

In the above signal processing apparatus, the readout means counts the reference signals to provide a count output including a lower bit output and a upper bit output, and said means successively reads out instructions of the process program in accordance with the lower bit output and simultaneously designates channels in accordance with the upper bit output. Therefore, the process program prepared for processing data for one channel is allowed to control operation for a plurality of channels. As a result, only a small area is required for storing the process program, and a sub-routine jump is not needed so that the net time for performing operation is not reduced and peripheral circuits may be omitted. Therefore, a simple and easy circuit design is allowed, and low costs for designing and manufacturing apparatus are expected.

BRIEF DESCRIPTION OF DRAWINGS

The above, and other objects, features and advantages of the invention will be clearly understood by those skilled in the art from the description of preferred embodiments of the invention and accompanying drawings, in which.

DETAILED DESCRIPTION OF THE PREFERRED EMBODIMENTS

Now, embodiments of the present invention will be described with reference to the accompanying drawings.

FIGS. 1 to 5 are views showing the first embodiment of the signal processing apparatus used in an electronic musical instrument. The first embodiment is applied to an apparatus of eight channels which generates a signal having a step waveform.

Figure 1:
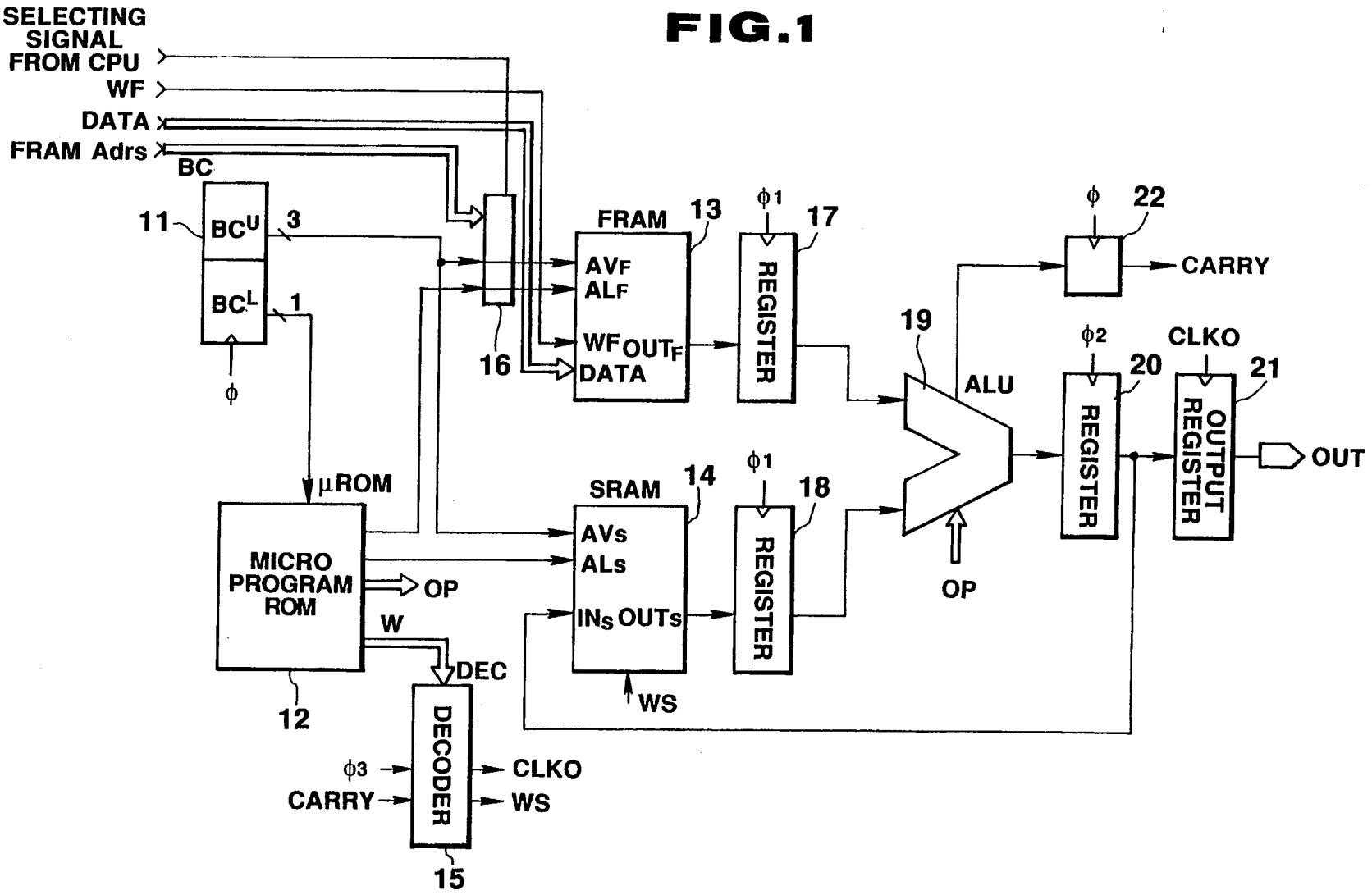
FIG. 1 is a whole circuit diagram of the first embodiment of a signal processing apparatus according to the present invention.
Figure 2:
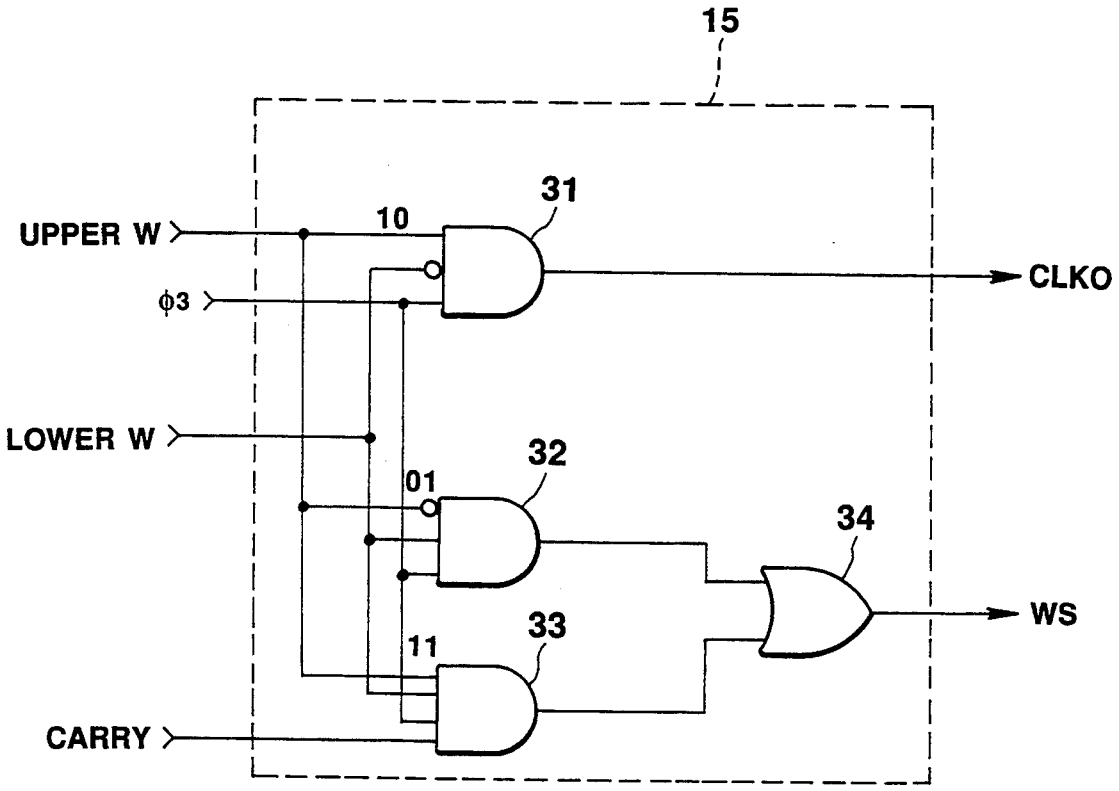
FIG. 2 is a circuit diagram of a decoder used in the first embodiment.

Now, a whole construction of the first embodiment will be described. FIG. 1 is a whole circuit diagram of the signal processing apparatus. In FIG. 1, a numeral 11 stands for a basic counter (BC), which works under control of an externally supplied clock signal Ø. The content of the basic counter (BC) 11 is divided into a lower bit output BCL (number of bits is one) and a upper bit output BCU (number of bits is three). The lower bit output BCL is used as an address counter for reading out program data from a microprogram ROM 12 while the upper bit output BCU is used as an address counter for reading out data from data memories FRAM 13 and SRAM 14. The program ROM 12 stores instructions for operation to be performed by an operational element (hereafter referred to as ALU) 19, as will be described later. When supplied with address data of the lower bit output BCL, the microprogram ROM 12 outputs operation data OP to ALU 19 in accordance with the supplied address data, and simultaneously supplies an instruction decoder (DEC) 15 with data W, which indicates where a result of output to be transferred, and further outputs predetermined data to the data memories FRAM 13 and SRAM 14. The instruction decoder (DEC) 15 receives data W from the microprogram ROM 12 and is further supplied with clock signals Ø3 (refer to FIG. 4) and a carry signal CARRY, which are decoded into an output-timing signal CLKO and a write-timing signal WS. More specific construction of the instruction decoder (DEC) 15 is shown in FIG. 2. The data memory FRAM 13 is provided at its input side with an address selector 16, which selects an address at receipt of a selecting signal from CPU. Through the address selector 16, the data memory FRAM 13 receives predetermined FRAM address data, the upper bit output BCU of the basic counter (BC) 11 and output data of the microprogram ROM 12, and further receives address data WF and data DATA. The output OUTF of the data memory FRAM 13 is supplied to ALU 19 through a register 17, and the output OUTS of the data memory SRAM 14 is also supplied to ALU 19 through a register 18. The registers 17 and 18 work under control of clock signals Ø1 (refer to FIG. 4). The operational element ALU 19 performs operation on the output OUTF of the data memory FRAM 13 and the output OUTS of the data memory SRAM 14 in accordance with the operation data OP fetched from the microprogram ROM 12. The operational element ALU 19 outputs the result of the operation to an output register 21 through a register 20 and further outputs the carry signal CARRY to a register 22. The registers 20 and 22 work under control of clock signals Ø2 and Ø, respectively, while the output register 21 works under control of the timing signal CLKO.

FIG. 2 is a circuit diagram of the instruction decoder (DEC) 15. As shown in FIG. 2, the instruction decoder (DEC) 15 consists of AND gates 31, 32 and 33, and OR gate 34. The AND gates 31, 32 and 33 are supplied with a upper bit and a lower bit (refer to FIG. 3A) of microprogram data W, and the third clock signals Ø3 shown in FIG. 4. The AND gate 33 is further supplied with the carry signal CARRY from the register 22. The microprogram data W of the microprogram ROM 12 indicates where an output result should be transferred to. The upper bit of the microprogram data W is inverted and input to AND gate 32 while the lower bit of the microprogram data W is inverted and input to AND gate 31. The AND gate 31 outputs the output-timing signal CLKO (refer to FIG. 4) for controlling the output register 21 while OR gate 34, i.e., OR logic circuit of AND gates 32 and 33, outputs a write-timing signal WS (refer to FIG. 4) to the data memory SRAM 14 for controlling writing operation of the operation result.

Figure 3A:
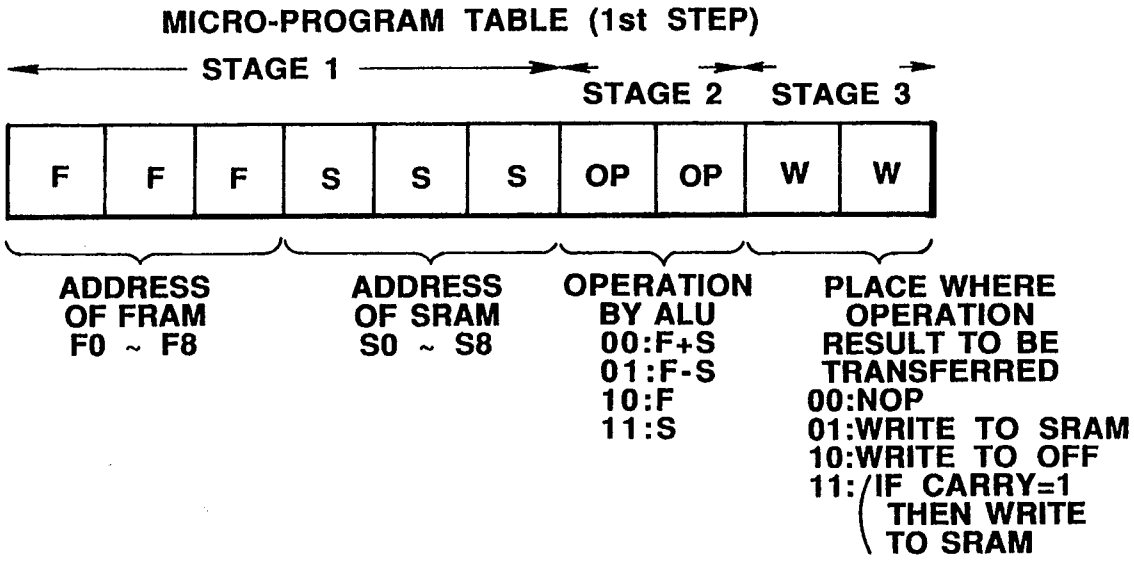
FIGS. 3A and 3B are views showing a instruction table of the micro-program and content of instruction respectively.
Figure 3B:
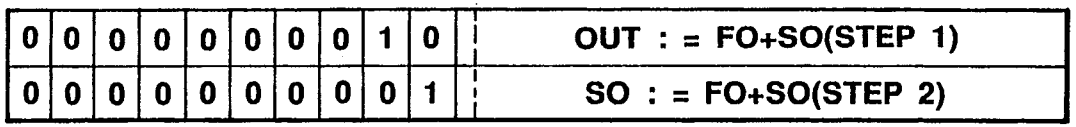

Now, operation of the first embodiment of the invention will be described. FIGS. 3A and 3B are views showing micro-program instructions. An instruction for step 1 is shown in FIG. 3A. As shown in FIG. 3A, the instruction for step 1 consists of a data RAM fetch instruction (stage 1), an operation-output fetch instruction (stage 2) and an operation-output transfer instruction (stage 3). More specifically, the data RAM fetch instruction (stage 1) consists of three bits (from the most significant bit to the third bit) representative of address F0 through F8 of the data memory FRAM 13 and next three bits representative of address S0 through S8 of the data memory SRAM 14. The operation-output fetch instruction (stage 2) consists of an operation instruction OP to be performed by ALU 19. The operation instruction OP of "00" instructs to execute addition (F+S) of data in the data memories FRAM 13 and SRAM 14, an instruction of "01" instructs to execute subtraction (F−S) to subtract data of the data memory SRAM 14 from data of the data memory FRAM 13, an instruction of "10" instructs to output data of the data memory FRAM 13 without effecting any process thereto, and an instruction of "11" instructs to output data of the data memory SRAM 14 without effecting any process thereto. The operation-output transfer instruction (stage 3) instructs where the result of operation performed by ALU 19 should be transferred. That is, the operation-output transfer instruction of "00" instructs to perform no operation, the instruction of "01" instructs to write the result of operation into the data memory SRAM 14, the instruction of "10" instructs to transfer the result of operation to the output register 21, and the instruction of "11" is instructs to write the operation result into the data memory SRAM 14 when the signal CARRY takes a value "1", and also the instruction of "11" instructs to write the result of operation into the data memory FRAM 13 when the signal CARRY takes a value "0". When the instruction for step 1, for example, is "0000000010" as shown in FIG. 3B, the operation OP to be performed by ALU 19 is "00" and the place W where the result of operation should be transferred is "10". Therefore, the sum of data in the data memories FRAM 13 and SRAM 14 is transferred to the output register 21. When the instruction for step 2 is "0000000001", the operation OP to be performed by ALU 19 is "00" and the place W where the operation-result should be transferred is "01". Therefore, the sum of data in the data memories FRAM 13 and SRAM 14 is written into the data memory SRAM 14. When, in the instruction decoder (DEC) 15 shown in FIG. 2, both the upper bit and lower bit of the micro program data W supplied from the microprogram ROM 12 are "0", both AND gates 31 and 32 are closed, and the output-timing signal CLKO is not output and no operation is performed. When the upper bit of the micro program data W is "0" and the lower bit is "1", only AND gate 32 is made open and the write timing signal WS is supplied to the data memory SRAM 14 under control of the third clock signal Ø3. When the upper bit of the micro program data W is "1" and the lower bit is "0", only AND gate 31 is made open and the output-timing signal CLKO is supplied to the output register 21 under control of the third clock signal Ø3. When the upper bit of the micro program data W is "1" and its lower bit is "1", only AND gate 33 is made open. Then, the write-timing signal WS is supplied to the data memory SRAM 14, when the AND gate 33 outputs a value "1" in accordance with the carry signal CARRY supplied thereto.

One channel corresponds to one musical tone channel, for which two sets of instructions for steps 1 and 2 (shown in FIGS. 3A and 3B) are executed. The instruction for step 1 is "OUT=F0+S0" and the instruction for step 2 is "S0=F0+S0", as shown in FIG. 3B.

Figure 4:
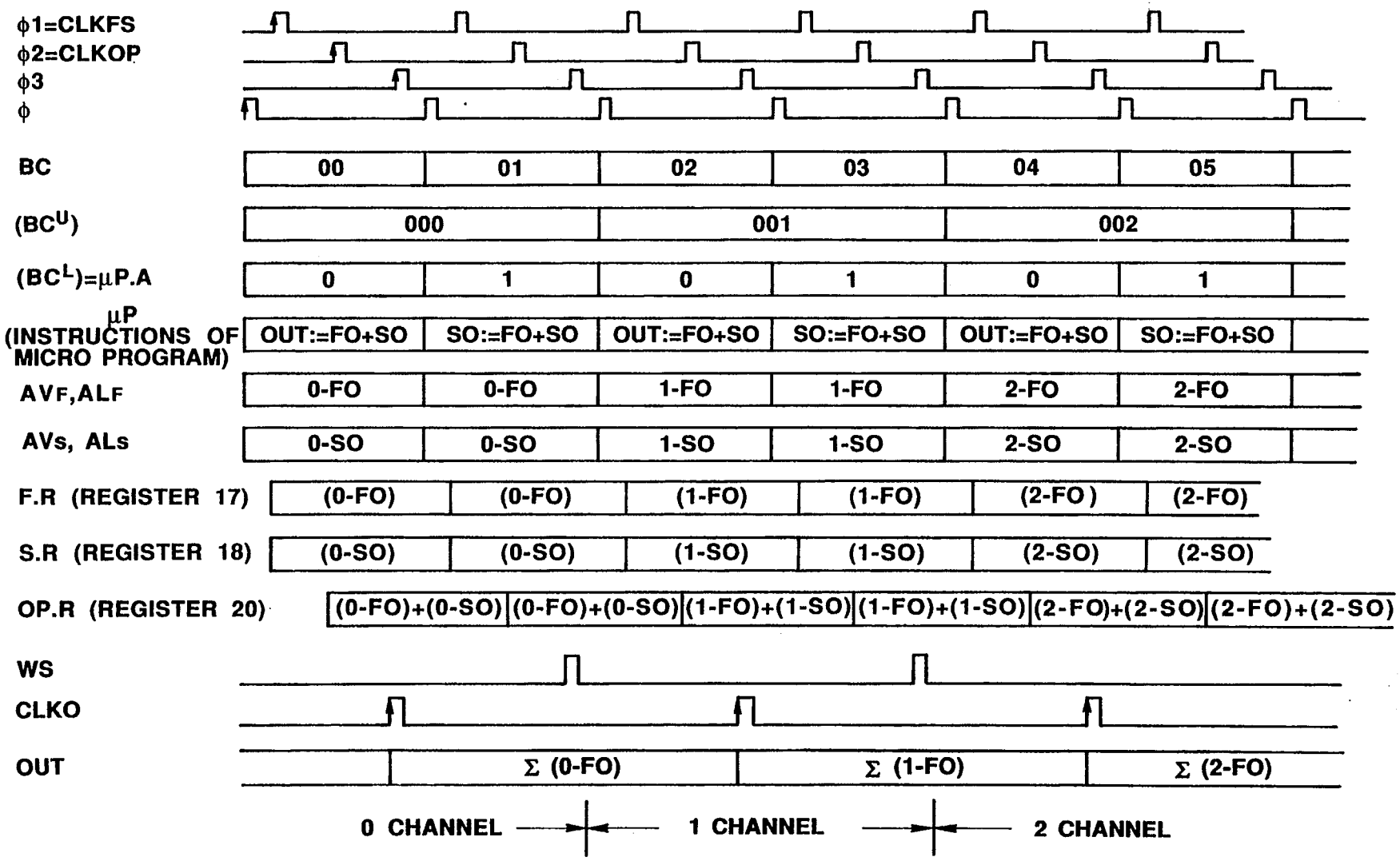
FIG. 4 is a timing chart for the first embodiment of the signal processing apparatus.

FIG. 4 is a timing chart of a step-waveform signal generating unit 50.

As shown in FIG. 4, the instruction for one channel consists of the instruction for step 1 "OUT=F0+S0" and the instruction for step 2 "S0=F0+S0" and the instruction for each step is executed under control of clock signals Ø, Ø1, Ø2 and Ø3 shown in FIG. 4. More specifically, the first clock signal Ø1 is denoted by CLKFS, under control of which addresses in the data memories FRAM 13 and SRAM 14 are read out. The second clock signal Ø2 is denoted by CLKOP, under control of which the result of operation obtained by ALU 19 is stored in the register 20. Under control of the third clock signal Ø3, the instruction decoder (DEC) 15 of FIG. 2 generates the output-timing signal CLKO and the write-timing signal WS. The data memory SRAM 14 receives the write-timing signals WS, storing therein the result of operation obtained by ALU 19 while the output register 21 receives the timing signal CLKO, outputting the result of operation obtained by ALU 19. In this case, the write-timing signal WS for writing the result of operation of ALU 19 is generated under control of the third clock signal Ø3 at step 2, and the result of operation for one channel is obtained. In this manner, the instructions for step 1 have been executed during the cycle of the clock signals Ø1, Ø2 and Ø3. The operation for step 2 starts at time when the clock signal Ø is received.

In FIG. 4, it should be noted that numerals "00", "01", . . . for the basic counter (BC) are expressed in 16 bit expression, the upper bit output BCU is expressed in 8 bit expression and the lower bit output BCL is expressed in 2 bit expression.

Now, operation of the first embodiment will be described with reference to the timing chart of FIG. 4.

As described above, operation for one channel is performed in accordance with two instructions (two steps). And one instruction of the micro-program consists of three stages, i.e., the data RAM fetch instruction (stage 1), the operation-output fetch (stage 2) and the operation-output transfer instruction (stage 3).

STEP 1 (BCL=0)

The microprogram ROM 12 is addressed by the lower bit output BCL of the basic counter (BC) 11 and the addressed instruction of step 1 (OUT:=F0+S0) is read out. Under this instruction, a content of the addressed data memory FRAM 13 and a content of the addressed data SRAM 14 are added together and the sum is transferred to the output register 21.

STAGE 1: (Data RAM fetch instruction)

Address data of the data memories FRAM 13 and SRAM 14 transferred from the micro-program ROM 12 will be input to lower addresses of RAM 13 and 14, respectively. Since the upper bit output BCU (=0 initially) has been input to the upper addresses of the data memories FRAM 13 and SRAM 14, F0 (CH0) (content at F0 for the channel 0) and S0 (CH0) (content at S0 for the channel 0) are latched in the following registers 17 and 18, respectively.

STAGE 2: (Operation-output fetch instruction)

OP of the microprogram instruction transferred from the microprogram ROM 12 designates the operation to be performed by ALU 19 (in this case, "addition" is instructed), the result of operation obtained by ALU 19, i.e., F0+S0 is latched to the output register 20.

STAGE 3: (Operation-output transfer instruction)

W of the microprogram instruction transferred from the microprogram ROM 12 designates the place where the result of operation to be transferred, and the clock signal CLKO or WS corresponding to the above place is output from the decoder (DEC) 15 and the result of operation is latched in the output register 21 at step 1.

STEP 2 (BCL=1)

The instruction at step 2 (S0:=F0+S0) is read out, which means that the contents at F0 of the data memory FRAM 14 and the content at S0 of the data memory SRAM 14 are added together and the sum is written into S0 of the data memory SRAM 14.

At stages 1 and 2, operations similar to those at step 1 are performed. At stage 2 of step 1, data is supplied to the output register 21 while, at stage 2 of step 2, the write-timing signal WS is supplied to the data memory SRAM 14 and the sum is written into the address S0 of the data memory SRAM 14.

Figure 5:
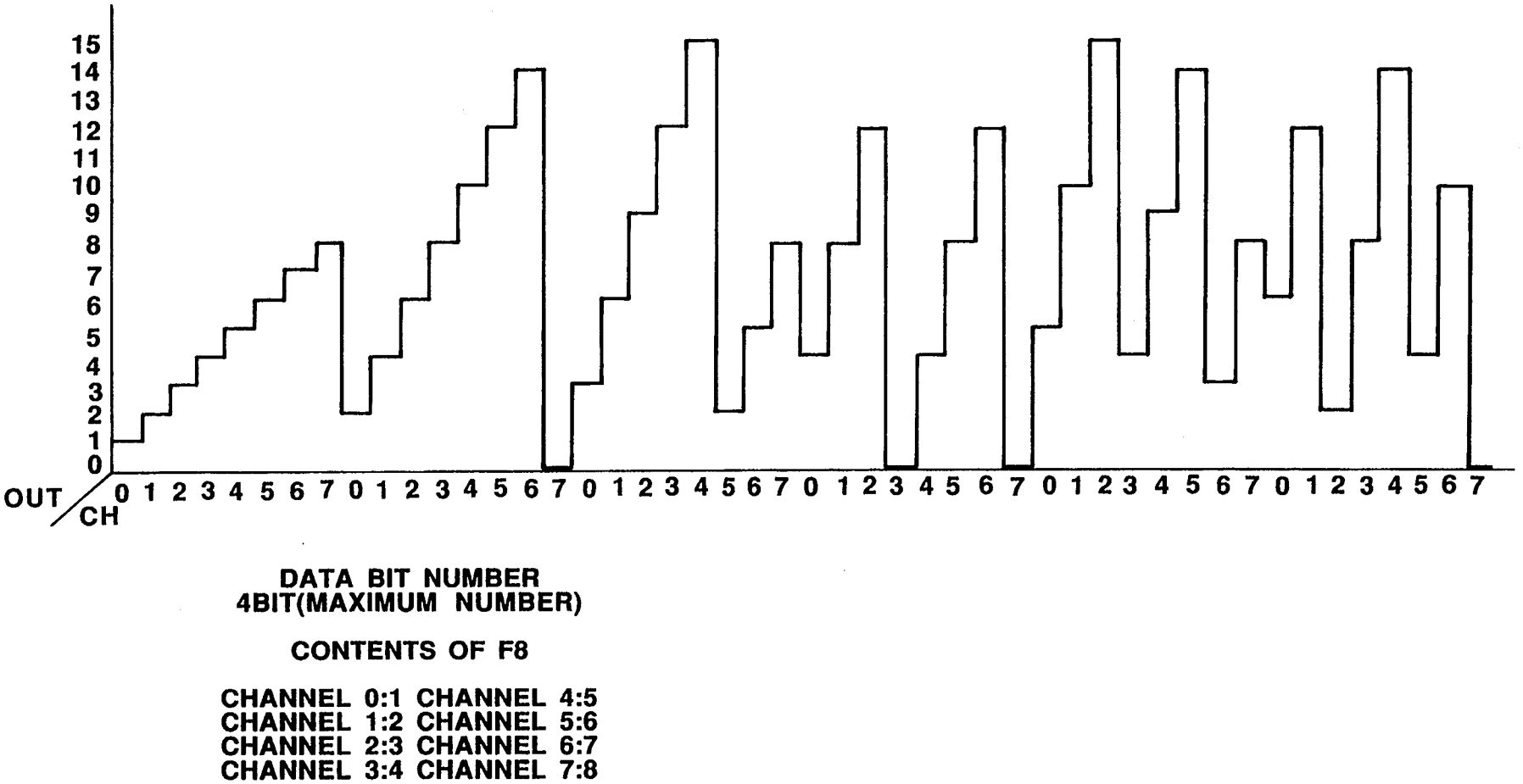
FIG. 5 is a view showing outputs of the first embodiment of the signal processing apparatus.

As described above, the content at F0 of the data memory FRAM 13 is added to the content at S0 of the memory SRAM 14 every timing (BCU=0) for the channel 0 and the result is output through the output register 21. Therefore, a step-waveform signal as shown in FIG. 5 is generated, step level of which is equivalent to the content at F0 of the data memory FRAM 13. After completion of operation for the channel 0, a value "1" is set to the upper bit BCU of the basic counter (BC) and operation for channel 1 starts.

Number of bits of data is four (maximum number is 16) and the content at F0 of the data memory FRAM 13 is added to the content at S0 of the memory SRAM 14 for the channel 0, twice the content at F0 of the data memory FRAM 13 is added to the content at S0 of the memory SRAM 14 for the channel 1, three times the content at F0 of the data memory FRAM 13 is added to the content at S0 of the memory SRAM 14 for the channel 2 and similarly eight times the content at F0 of the data memory FRAM 13 is added to the content at S0 of the memory SRAM 14 for the channel 7. Since one and the same microprogram is also used for channels other than channel 0, step-waveform signals each having a step level corresponding to each content at F0 are generated at respective timings. In other words, in accordance with a single microprogram prepared for one channel, step-wave signals having different step-levels are generated when different values are written in F0 for respective channels.

Figure 6:
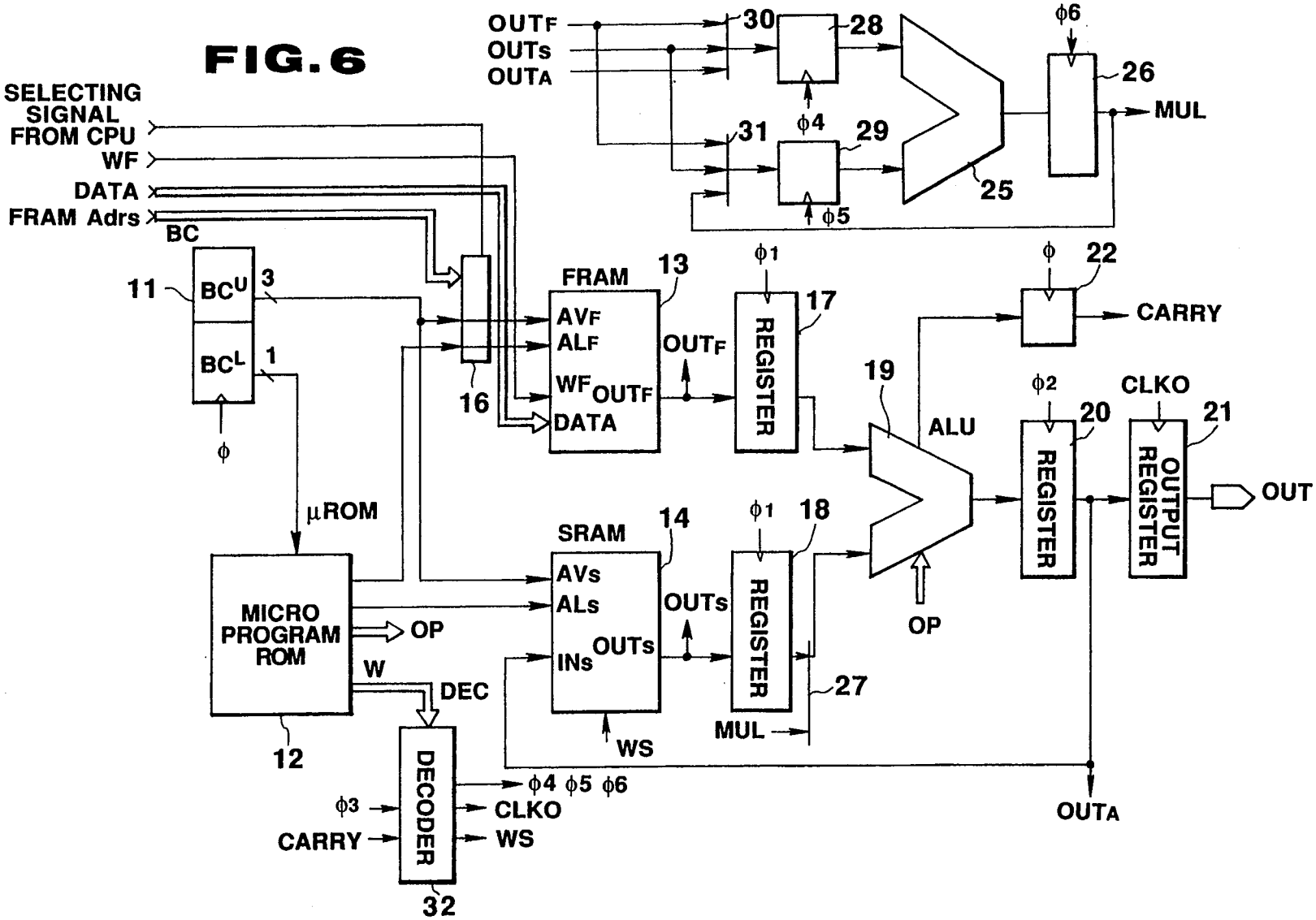
FIG. 6 is a whole circuit diagram of the second embodiment of the signal processing apparatus according to the present invention.

FIG. 6 is a circuit diagram of the second embodiment of the present invention. The second embodiment is suitable to be used as an effecting machine that generates a signal similar to that obtained through a tube amplifier to which a sine-wave data is input.

In FIG. 6, like elements as those in the first embodiment shown in FIGS. 1 to 5 are designated by like reference symbols, and their description is omitted there.

As shown in FIG. 6, it is remarkable that the second embodiment is provided with a multiplication circuit 25 for performing a multiplication processing.

The output data of the multiplication circuit 25 is supplied to an output register 26 and is latched therein under control of a clock signal Ø6. The output MUL of the output register 26 is supplied through a selector 27 to one of input terminals of ALU 19 together with the output data of the register 18.

The multiplication circuit 25 is supplied with output data of registers 28 and 29. The register 28 latches an input data under control of a clock signal Ø4 while the register 29 latches an input data under control of a clock signal Ø5. The register 28 is supplied with an output data of a selector 30. The selector 30 receives the output OUTF of the data memory FRAM 13, output OUTS of the data memory SRAM 14 and output OUTA of the output register 20. The register 29 is supplied with an output data of a selector 31. The selector 31 receives the output OUTF of the data memory FRAM 13, output OUTS of the data memory SRAM 14 and output OUTA of the output register 26.

The selectors 27, 30 and 31 serve to select and output one of data input thereto under control of the output data of the instruction decoder (DEC) 32. The instruction decoder (DEC) 32 outputs the output signal on the basis of data W from the microprogram ROM 12. The clock signal Ø4 to be supplied to the registers 28 and 29, and the clock signal Ø5 to be supplied to the output register 26 are generated on the basis of the output data of the instruction decoder (DEC) 32. ALU 19 has a mode for transferring data of the register 18 to the register 20 in accordance with the signal OP from the microprogram ROM 12 in addition to the mode for performing addition and/or subtraction.

Figure 7:
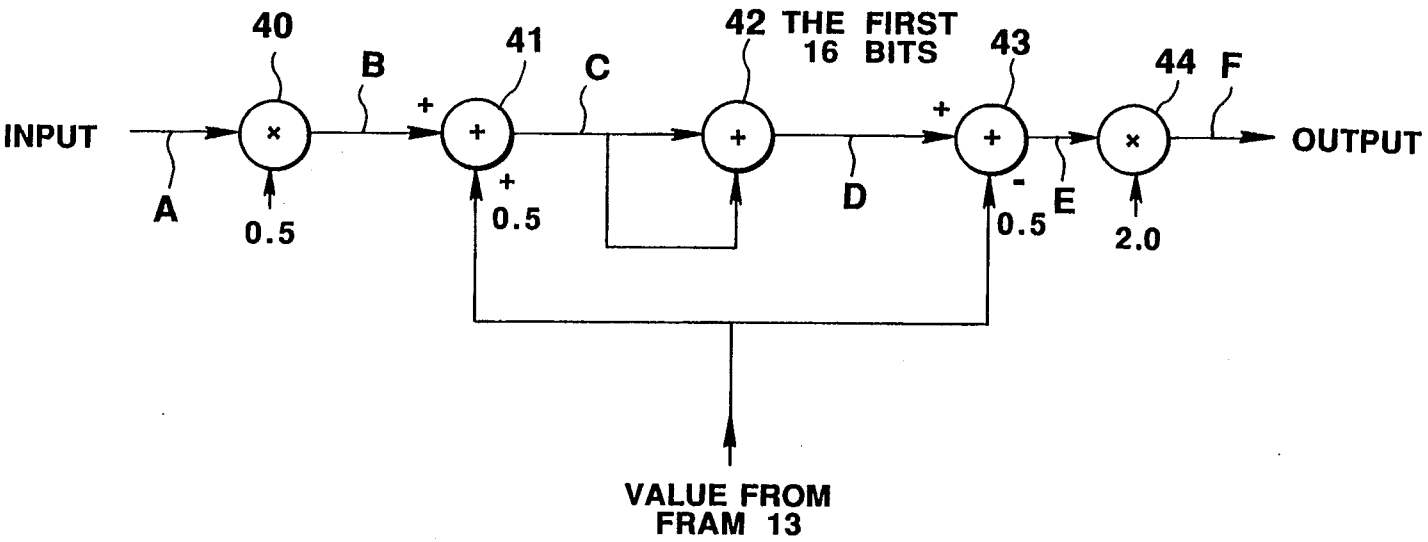
FIG. 7 is a block diagram including operational elements, showing operation of the second embodiment of FIG. 6.

FIG. 7 is a circuit diagram of the second embodiment of the signal processing apparatus, showing, with aid of symbols of operation, operation process performed therein for one channel. FIGS. 8A through 8F are views showing waveforms of signals Generated by the operation process. The waveform signals (data) shown in FIGS. 8A through 8F, for example, are data of 16 bits, but are expressed in decimal number for simplicity. The upper and lower limit of the dynamic range are defined by "+1" and "−1", respectively.

Figure 8A:
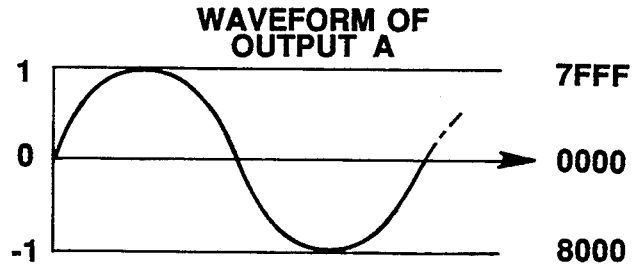
FIG. 8 is a view showing waveforms of signals appeared at various points on the block diagram of FIG. 7.
Figure 8B:
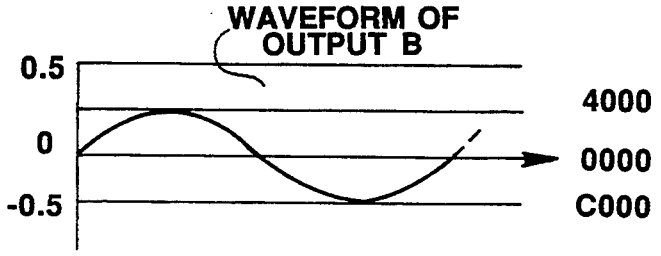

In the block diagram of FIG. 7, a multiplier 40 multiplies an input digital-signal A (having the maximum level "+1" and the minimum level "−1") of 16 bits by "0.5". Then, the amplitude of the input signal A is reduced by "½". That is, the input signal A is transferred to a signal B having the maximum level of "+0.5" and the minimum level of "−0.5" (FIGS. 8A and 8B).

Figure 8C:
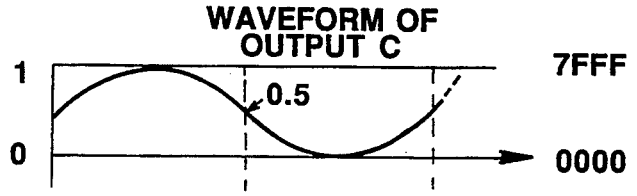

An adder 41 adds a predetermined value (an addend), for example, "0.5" supplied from the data memory FRAM 13 to the signal B output from the multiplier 40. Then, the signal B is transferred to a signal C having the maximum level "+1" and the minimum level "0" (FIGS. 8B and 8C).

Figure 8D:
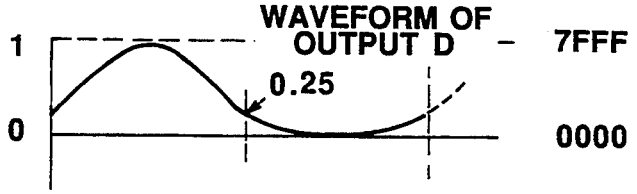

A multiplier 42 receives the signal C from the adder 41, squares the input signal C, and outputs the first 16 bits of the result of operation. As the result of squaring process, the waveform of the signal C is varied such that the levels of "+1" and "0" of the signal C remain unchanged but other levels of the signal C are reduced rapidly as the level comes from a level "+1" to a level "0". For example, a level of "0.5" of the signal C is reduced to a level "0.25". The signal C is transferred to a signal D, which has the maximum level "+1" in its first half cycle and the minimum level "0" in the following half cycle, but which rises and drops comparatively sharply in the first half cycle and changes dully in the following half cycle (FIGS. 8C and 8D).

Figure 8E:
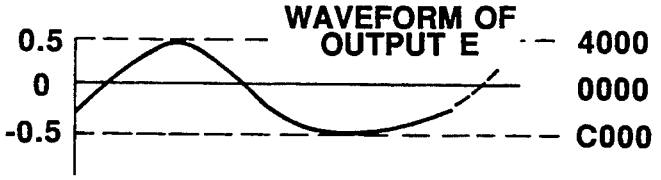

A subtracter 43 receives the signal D from the multiplier 42 and subtracts a predetermined value (a subtrahend), for example, "0.5" supplied from the data memory FRAM 14 from the signal D. As the result of the subtraction, the maximum level of the signal D remains in the positive region but its minimum level falls into the negative region (a signal E) (FIGS. 8D and 8E). If an equivalent value is employed as the above addend and subtrahend, the maximum level of the signal E will be "+0.5" and the minimum level will be "−0.5". That is, the maximum level and the minimum level of the signal E will be equivalent to those of the signal B respectively, which is to be supplied to the adder 41 for modulation.

A multiplier 44 receives the signal E from the subtracter 43 and multiplies the signal E by "2". As the result, the signal E is transferred to a signal F which has the same dynamic range from "+1" to "−1" as that of the input signal A (FIGS. 8E and 8F).

Figure 8F:
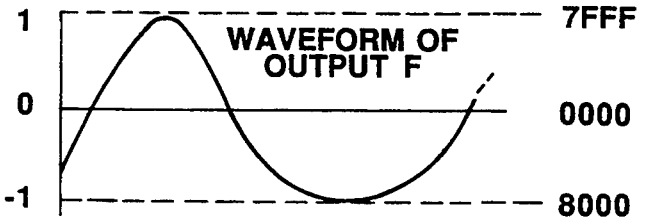

As described above, the sine wave data input thereto shown in FIG. 8A is transferred to a waveform data, which rises and drops sharply in the first half cycle (ratio of the amplitude to a pitch or a length between points at which the sine wave data crosses the zero level is large), and drops and rises dully in the following half cycle (the ration of the amplitude to a pitch is small), as shown in FIG. 8F. This waveform data is substantially equivalent to a signal which was subjected to a vacuum tube effect.

Figure 9:
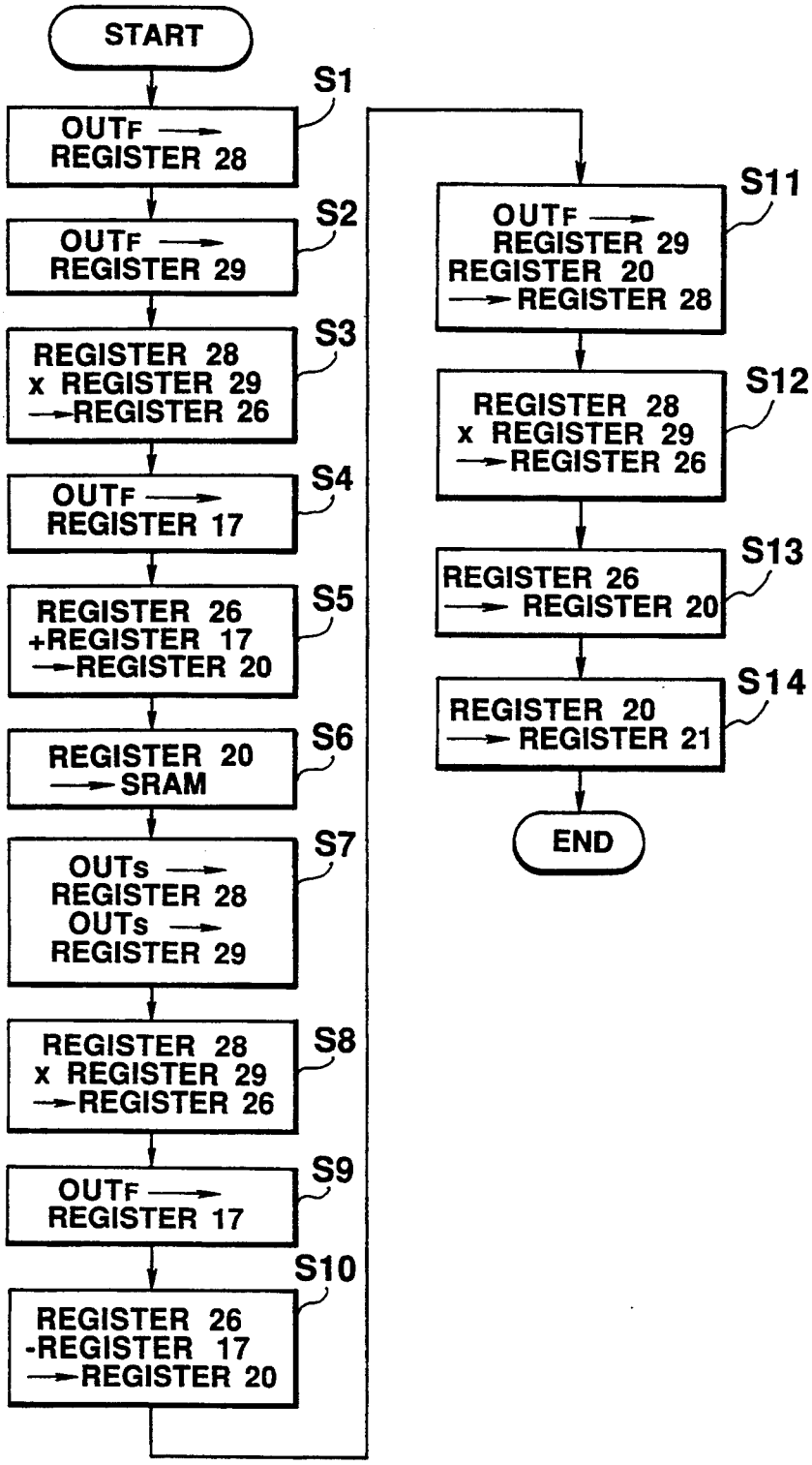
FIG. 9 is a flowchart of operation of the second embodiment.

FIG. 9 is a flowchart showing operation of FIG. 7 performed in the second embodiment.

At step S1, an coefficient (0.5) is read out from the data memory FRAM 13 and is latched in the register 28. At step S2, input waveform data stored in the data memory FRAM 13 is latched in the register 29. Data stored in the registers 28 and 29 are multiplied to each other in the multiplier 25 and the result is conveyed to the register 26 at step S3. This process corresponds to the operation of the multiplier 40 of FIG. 7. Thereafter, a coefficient (0.5) is read out from the data memory FRAM 13 and is latched in the register 17 at step S4. The output data of the register 17 and the output data supplied through the selector 27 from the register 26 are added together in ALU 19, and the sum is latched in the register 20 at step S5. This process corresponds to operation of the adder 41 of FIG. 7.

The output data of the register 20 is temporarily stored in the data memory SRAM 14 at step S6 and this value is read out again and is latched in the registers 28 and 29. Output data from the registers 28 and 29 are multiplied to each other in the multiplier 25 and the result is conveyed and latched in the register 26 at step S8. This process corresponds to the operation of the multiplier 42 of FIG. 7.

Further, a coefficient (0.5) is read out from the data memory FRAM 13 and is latched in the register 17 at step S9. At step S10, ALU 19 subtracts data of the register 17 from data of the register 26 and latches the difference in the register 20. This process corresponds to operation of the subtracter 43 of FIG. 7.

At step S11, an coefficient (20) is read out from the data memory FRAM 13 and is output to the register 29. And data of the register 20 is latched in the register 28. At step S12, data stored in the registers 28 and 29 are multiplied to each other in the multiplier 25 and the result is latched in the register 26. This process corresponds to the operation of the multiplier 44 of FIG. 7.

Data of the register 26 is transferred and latched to the register 20 through the selector 27 and ALU 19 at step S13. At the following step S14, data in the register 20 is transferred to the output register 21 under control of the clock signal CLKO supplied from the instruction decoder (DEC) 32.

Now, the operation process on waveform data for one channel has been completed at steps S1 through S14. Similar operation process is performed for each channel. In this case, a coefficient read out from the data memory FRAM 13 takes a value which falls within a range previously designated for each channel and is selected on the basis of the upper bit of the basic counter (BC) 11 as well as data supplied from the microprogram ROM 12.

In this manner, waveform data for a plurality of channels are input to the signal processing apparatus in a time sharing fashion and are successively processed and output.

The first and second embodiment described above are provided with the microprogram ROM 12 storing the process-program prepared for one channel and the basic counter (BC) 11, which counts the clock signals Ø to provide a count-output of a plurality of bits, and successively reads the microprogram from the microprogram ROM 12 on the basis of the lower bit output BCL of the count output and designates a channel on the basis of the upper bit output BCU of the count output. The above embodiments employs no program counter adapted for controlling the flow of operation but the basic counter (BC) 11 which successively reads the microprogram at a constant rate. In accordance with the microprogram read by the basic counter (BC) 11, data are processed on the basis of signal data input thereto, and data thus processed are assigned to a plurality of channels on the basis of the upper bit output BCU of the basic counter (BC) 11. Therefore, a microprogram prepared for one channel allows operation to be performed for a plurality of channels, and only a small memory area is required for storing the microprogram. Furthermore, a program counter and other peripheral logic circuits are omitted. As a result, an easy design of LSI and a larger scale integrated circuit are allowed.

The first embodiment of the signal processing apparatus for an electronic musical instrument is applied to a signal generating apparatus which generates step-wave signals as musical tone waveforms while the second embodiment is applied to an effecting device which imparts special effects onto input signals. But the present invention may be applied to various appliances other than the above signal generating apparatus and effecting machine. It is noted that the signal processing apparatus of the present invention may be employed in any signal processing apparatus other than the above step-wave signal generating apparatus, in which the above described signal processing is performed, such as a sound source in an electronic musical instrument, an effecting machine for imparting effects onto input signals, an audio system and a communication system which transmits data in a time sharing fashion.

The embodiments including eight channels have been described but any number of channels may be employed in the signal processing apparatus.

It should be understood that number of decoders, operational elements and registers used in the signal processing apparatus is by no means limited to the same number as that in the embodiments, and further their characteristics are not always equivalent to those in the embodiments.

What is claimed is:

1. A signal processing apparatus comprising:

data input means for inputting data for a plurality of channels;

clock signal generating means for generating reference clock signals;

first memory means having a single memory area for storing a process program prepared for a single one of said channels, said process program including a plurality of program steps used for processing of the data which is inputted by said data input means;

readout means for counting the reference clock signals generated by said clock signal generating means to provide a count output of a plurality of bits, and for successively designating said channels on the basis of upper bits output of the count output, and for reading out all the plurality of program steps of the process program stored in said first memory means on the basis of lower bits output of the count output, while one of said channels is designated; and processing means having a plurality of channels, for processing the data inputted to the channel designated by said readout means in accordance with the process program readout of said first memory means by said readout means, and for assigning the processed data to the designated channel.

2. A signal processing apparatus according to claim 1, wherein said processing means comprises:

second memory means for temporarily storing the data inputted by said data input means, and for outputting data in accordance with the process program read out from said first memory means;

third memory means for storing data;

operation means for performing an operation, in accordance with the process program read out from said first memory means, on the data output from said second memory means and data stored in said third memory means; and selecting means for selecting in accordance with the result of the operation performed by said operation means and the process program read out from said first memory means, whether the result of the operation is directly outputted or the result of the operation is stored in said third memory means.

3. A signal processing apparatus according to claim 1, wherein:

said data input means includes means for inputting a plurality of performance data; and said processing means includes means for processing the performance data in accordance with the process program read out by said readout means to generate musical tones.

4. A signal processing apparatus according to claim 1, wherein:

said data input means includes means for inputting a plurality of musical tone data; and said processing means includes means for processing the musical tone data in accordance with the process program read out by said readout means.

5. A signal processing apparatus comprising:

data input means for inputting data of a plurality of channels to be processed;

program memory means having a single memory area for storing a process program prepared for a single one of said channels, said process program including a plurality of program steps used for processing of the data which is inputted by said data input means;

clock signal generating means for generating reference clock signals;

counting means coupled to said clock signal generating means for counting the reference clock signals, upper bits of the count output of said program memory means and lower bits of a count output of said counting means designating an address of said program memory means while one of said channels is designated; and processing means, having a plurality of channels, coupled to said program memory means and to said counting means, for respectively processing the data of respective channels designated by the upper bits of the count output based on all the plurality of program steps of the process program readout from said program memory means addressed by said lower bits of said count output.

* * * * *